US005923241A

United States Patent [19]

Cascan Garvalos

[11] Patent Number: 5,923,241

[45] Date of Patent: Jul. 13, 1999

[54] POTENTIOMETER WITH REMOVABLE CONTROL SHAFT

[75] Inventor: Santiago Cascan Garvalos, Tarazona, Spain

[73] Assignee: Aragonesa de Componentes Pasivos, S.A., Tarazona, Spain

[21] Appl. No.: 08/875,390

[22] PCT Filed: Nov. 27, 1996

[86] PCT No.: PCT/ES96/00227

§ 371 Date: Sep. 18, 1997

§ 102(e) Date: Sep. 18, 1997

[87] PCT Pub. No.: WO97/20325

PCT Pub. Date: Jun. 5, 1997

[30] Foreign Application Priority Data

Nov. 29, 1995 [ES] Spain ..... P 9502355

[51] Int. Cl.[6] ..... H01C 10/32

[52] U.S. Cl. ..... 338/162; 338/174

[58] Field of Search ..... 338/162, 163, 338/175, 196, 174

[56] References Cited

U.S. PATENT DOCUMENTS

| | | | |
|---|---|---|---|
| 2,745,927 | 5/1956 | Daily et al. | 338/162 |
| 3,662,314 | 5/1972 | Heredero | 338/163 |
| 4,081,781 | 3/1978 | Petterson | 338/196 |
| 4,296,292 | 10/1981 | Schuberth et al. | 200/336 |
| 4,465,994 | 8/1984 | Rehberger | 338/164 |
| 4,812,803 | 3/1989 | Hochholzer | 338/175 |
| 5,592,141 | 1/1997 | Aldae et al. | 338/162 |

FOREIGN PATENT DOCUMENTS

| | | | |
|---|---|---|---|
| 466765 | 10/1978 | Spain . | |
| 277067 | 11/1984 | Spain | H01C 10/00 |
| 288467 | 8/1986 | Spain | H01H 43/16 |
| 2008980 | 3/1988 | Spain . | |
| 2008980 | 8/1989 | Spain | G61R 17/20 |
| 1171544 | 11/1969 | United Kingdom | H01C 9/02 |

*Primary Examiner*—Teresa Walberg
*Assistant Examiner*—Jeffrey Pwu
*Attorney, Agent, or Firm*—Merchant, Gould, Smith, Edell, Welter & Schmidt, P.A.

[57] ABSTRACT

A potentiometer element housed in an anchoring body which is provided at the extremities of its walls with a plurality of lugs which are deformable angularly in order to hold the potentiometer element, also incorporating a control shaft wherein the insertion extremity of the shaft presents a groove which forms two elastic lugs which, when brought closer to each other permit the removal and replacement of said control shaft. The potentiometer element is also characterized in that, in the system of contacting the resistive track with the ends of the corresponding terminals, there are provided two or more protuberances which act as springs, and terminals present a notch so as to facilitate the bending and to reduce the recovery effect.

9 Claims, 4 Drawing Sheets

POTENTIOMETER WITH REMOVABLE CONTROL SHAFT

FIELD OF THE INVENTION

The present description relates, as indicated in its title, to an improved potentiometer also know as adjustment semi-drive potentiometer intended for use preferably in electronic circuits.

BACKGROUND OF THE INVENTION

In the present state of the art certain potentiometers are known, which in some cases have a housing in which they ore located and retained by means of a plange which provides the fixing of the unit to its corresponding support or base by means of a pin having a threaded portion at its outer surface, while inside of said pin slides a shaft, which is attached to the pointer and through the activation thereof, allows for the desired adjustments of said potentiometer. These potentiometers, use the process of bending the ends of terminals over the coinciding ends of resistive plate in order to provide contact between said terminals, whereby in order to obtain the desired contact a considerable pressure is to be exerted thereupon. The collector of the potentiometers to which reference is being made, incorporate at a central point thereof a cylindrical shape provided for guiding the end of the pointer carrier, said cylindrical shape being formed by means of bending and pressing the material towards outside. In other cases, said cylindrical shape is obtained simply by a punching action. Further, to be mentioned as a constructive element in the known potentiometers is the flanging of the pointer carrier over the collector thus allowing for the sliding and guiding of said pointer carrier.

The aforementioned potentiometers have the problem of not having a uniform and reliable rigidity or absence of movement between the potentiometer as such and the housing in which it is located, because the perimetral flanging for fixation requires a highly controlled pressure, in order to avoid, in some cases, deformation of the element, and in others, to provide an ostensible clearance. Iqually to the previous case, the flanging of the pointer carrier turns out to be somewhat troublesome because if the pressure applied is not sufficient, clearances would be formed, whereas if said pressure is too strong, an excessive friction with the cylindrical shaped collector which would cause difficulty in the sensibility of the adjustment of the rotor and the pointer over the resistive track. Also, obstruction in the rotation of the pointer carrier may be caused by the presently existing operations for drilling the collector as in the case of bending, the point of stretching may suffer breakage which obviously dampers a regular sliding of the pointer carrier, whereas in the case said drilled portion is punched, rough edges are logically produced which undisreably damper the uniform rotation of the pointer carrier.

Another problem which the present potentiometers have is that if the control shaft is damaged, it cannot be substituted and the complete potentiometer would be thrown away.

The bending or nipping which presently is practiced for transmitting the electric energy by contact between the resistive track and the associated terminals thereof presents the drawback of producing intermittent losses of electric continuity because the system used for bending the lug permits a logical recovery of the material which tends to loosen off from the opposing contact surface. In the case of attempting to avoid the aforementioned loosening off by applying a higher constant force in the bending, one faces the risk of obtaining excessive deformations which damage the element.

SUMMARY OF THE INVENTION

In order to overcome the aforementioned problems, the improved potentiometer object of the present invention is proposed, which is constituted by three clearly differentiated elements which are a potentiometer element, an anchoring body and a control shaft.

The potentiometer includes a squared shape body of variable height, inside which a resistive track is inserted and remains firmly stapled to the aforementioned body due to a pressure exerted by bent over lugs which correspond to the extremity of terminals of the same, which in turn are intended to contact with the mentioned resistive track in order to transmit a regulated electric energy. The aforementioned constant pressure is obtained by means of bent lugs, which in order to avoid the effect of recovery after the bending have incorporated a notch precisely at the point intended for bending. Also in order to maintain the constant pressure between the resistive track and the bent ends of the terminals, a number of slight protuberances cooperate which are located at the bottom of the body, precisely coinciding with the zone of the resistive track corresponding to the stapled portion of the terminals, such that when the programmed pressure is exerted in order to effect the bending of the lugs of the terminals over the ends of the resistive track, the latter logically transmits its pressure to the protuberances, which yield a variable height which is later recovered in its major part. Thus, by being minimal the recovery of the bent portion of the terminals, a spring type effect is obtained with the protuberances which assure a constant pressure between the resistive track and the associated terminals. The pointer remains inserted in the pointer carrier due to the corresponding guides which the latter has, assuring also immovability due to an incisive design of the angles of the lugs intended for interlocking of the same. The pointer carrier rotor is attached to the body or housing at a lower part thereof, 3 or more notches or riveting points have been provided, which facilitates a contact and regular sliding of the pointer both in relation to the collector, and to the resistive track. The collector of laminer constitution has a central hole which is designed such that, by means of a stamping or pressing of the material it is possible to form at the lower part thereof a bevelled portion, while at the upper part thereof a circular profile is extended which ends at a radius which coincides at the inner part thereof with the shape of the drilled portion, whereas at the outer part, said radius coincides with an inclined line which falls of the external base of the collector.

The anchoring body at the zone where the potentiometer is situated, has a squared-shape configuration, having as extended portion of its walls a plurality of lugs, which by being bent towards inside due to plastic deformation, assure the fixing of the potentiometer. Also in the fixing of the potentiometer inside the anchoring body, various concave curved-shape notches cooperate with inner convex curved-shape salients which correspond, as it is understood, to the housing of the potentiometer and the anchoring body, in both cases towards the upper part thereof. One side of the aforementioned squared-shape anchoring body has an opening in the form of a window, which is intended for displaying the printing corresponding to the model or the characteristics of the element. Opposit to the potentiometer and centrally situated with respect to the latter, the anchoring body contains a cylindrical body having two different inner diameters, the lower diameter intended for guiding the control shaft, while between the larger diameter and the control shaft a cavity is formed in which certain amount of lubricating grease is placed. The outer diameter of the mentioned cylindrical body has a threaded portion which allows for securing the potentiometer to the plate or the base upon which it is located.

The control shaft at the end where it is inserted in the potentiometer, has a device in the form of an elastic clip, capable of retaining the shaft inside its housing as long as use is not made of a suitable tool for acting upon the elastic part which yields for permitting the taking out of the mentioned shaft.

The improved potentiometer herein presented has multiple advantages over the ones presently known, from which the main improvement to highlight is that of the system of stapling of the terminals to the resistive track as described hereinabove, which provides that electric corrent is transmitted from the resistive track to the terminals in a stable and dropless manner since the pressure exerted by the protuberances of the body over the resistive track is performed in a continuous and regular manner which does not damage the resistive track.

Also contributing to the stability of the pressure of the stapling between the terminals and the resistive plate, is the system of bending the ends of the terminals, which due to a bent notch assure a minimal recovery after pressing. As a consequence of the stability of the stapling of the terminals and the aforementioned resistive track one can achieve to reduce to a minimum the defects of contact produced by expansion during welding the potentiometers by wave bath or other systems.

Another advantage provided is the rigid emplacement of the pointer over the pointer carrier rotor, obtained by the blocking lugs of the pointer whose end angles terminate in an incisive form in order to be inserted in its housing in the rotor.

This firmness between the rotor and the pointer contributes in providing to the potentiometer a better precision in relation to its adjustment, thus obtaining the same resistive valve at any point on the resistive plate irrespective of whether the rotor-pointer assembly rotates clockwise or counterclockwise.

Also as a significant advantage the guiding system of the pointer-carrier rotor inside the central drilled portion provided in the collector is to be mentioned, which due to its designs, allows for a regular rotation as the pressure existing between the neck of the pointer carrier rotor and the drilled portion guiding the same is very slight. The system of fixing the rotor to the collector with three or more points of riveting by plastic deformation also contributes to providing a smooth and regular sliding movement of the rotor-pointer assembly, thus avoiding variations in the rotational torque of the potentiometer. Also it is to be mentioned that the operation of fixing the pointer carrier rotor to the collector by riveting of three or more points through plastic deformation is easier to be carried out than a total flanging thus obtaining an economic saving both in tools and production time.

Another advantage provided by the present invention is derived from the particularities of the anchoring body, as it contains a window or opening in one of its walls, provided so as to make possible to see printed code or characteristics of the potentiometer.

Another advantageous particularity of the anchoring body consists of a cavity intended for placing a lubricant grease therein, said cavity being provided in the drilled portion where the control shaft passes through, thus the latter has a smooth and uniform rotation due to the lubricant element.

The system of fixing the potentiometer element inside the anchoring body presents another important advantage over the known means which use flanging, as the gripping system by means of multiple lugs or ribs which are bent through plastic deformation, as well as the lateral notches assure immobility between the two pieces, while at the same time a minimal and necessary pressure is exerted which not capable of causing deformations to the assembly.

Another advantage over the known means is that the control shaft is dismountable in the case of damage or deflect, thus giving rise to an important saving in waste of manufacture as well as in relation to the use which by simply substituting the control shaft would avoid the use of a new potentiometer.

Finally as another advantage it is mentioned that one may use an adjusting potentiometer as a control potentiometer of low cost.

BRIEF DESCRIPTION OF THE DRAWINGS

In order to better understand the object of the present invention, a preferred practical embodiment of the same has been represented in an extended manner in the accompanying drawings in which.

DETAILED DESCRIPTION OF PREFERRED EMBODIMENTS

Figure 1:
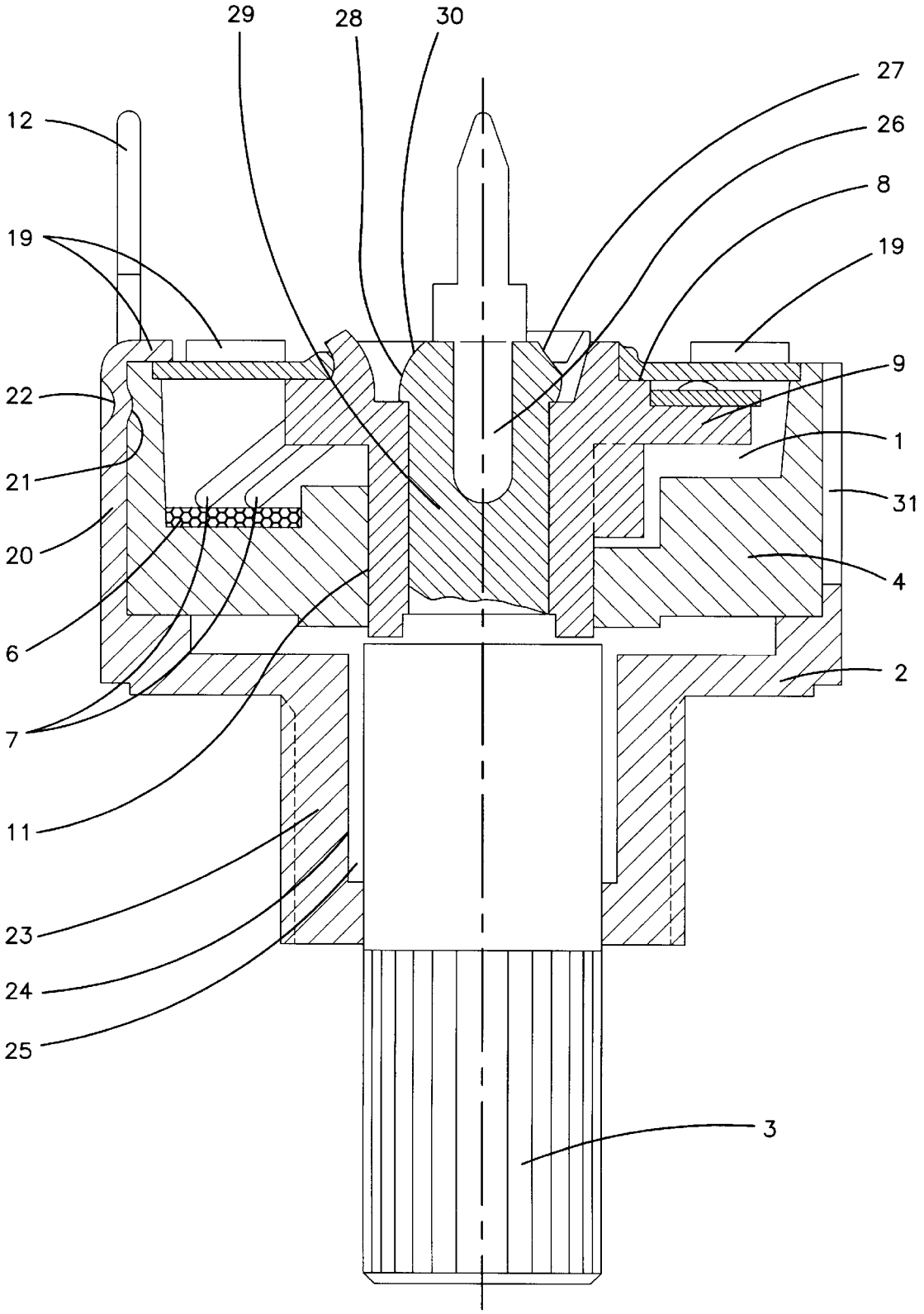
FIG. 1 shows the improved potentiometer cross-sectioned.
Figure 2:
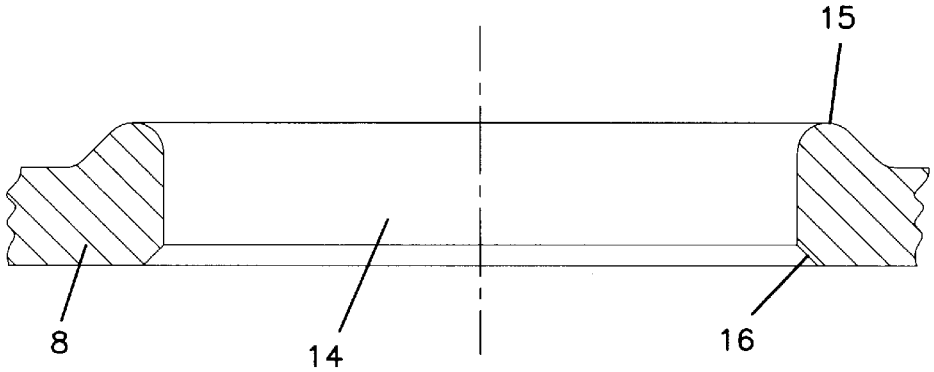
FIG. 2 shows a detail of the cross-section of the central register of the collector.
Figure 3:
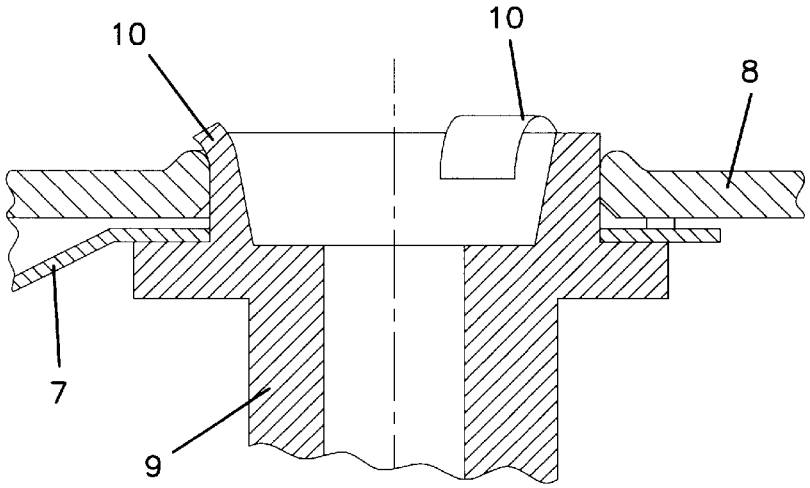
FIG. 3 shows a detail of the cross-section of the rotor-pointer assembly anchored to the collector.
Figure 4:
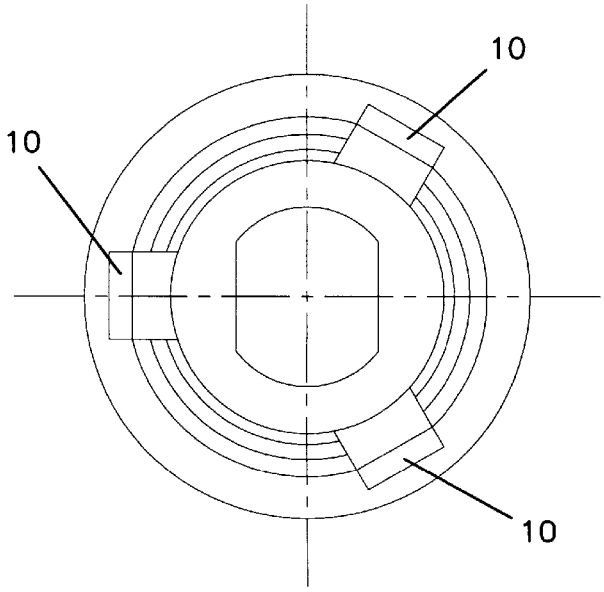
FIG. 4 shows an upper view of the anchoring lugs of the rotor to the collector.
Figure 5:
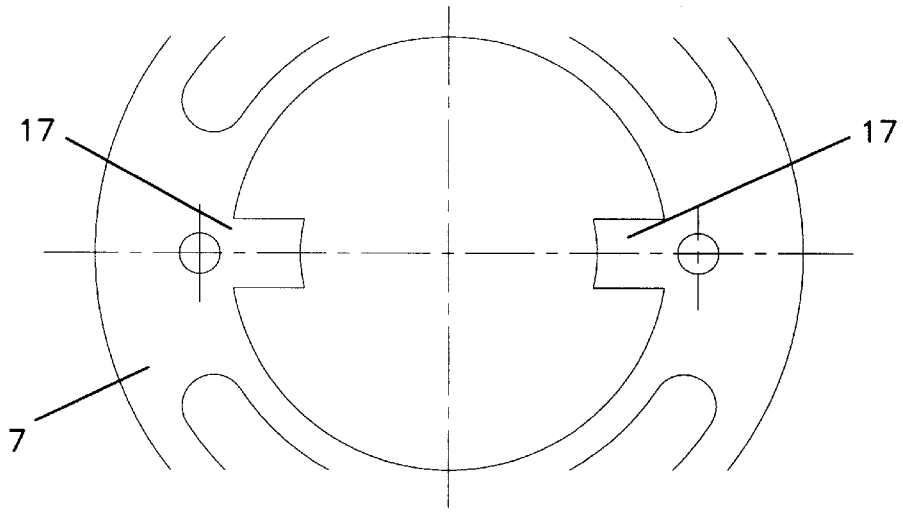
FIG. 5 shows an upper view of a detail of the cursor.
Figure 6:
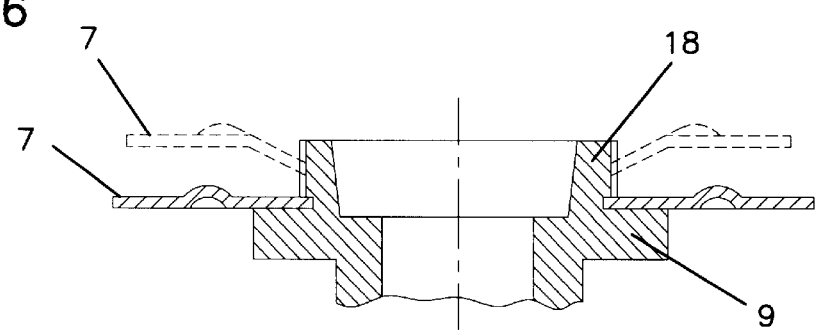
FIG. 6 shows a cross-section of the pointer anchored to the rotor, where a stage prior to the pressing which gives rise to the insertion of the lugs of the pointer inside the lodging of the rotor in broken lines.
Figure 7:
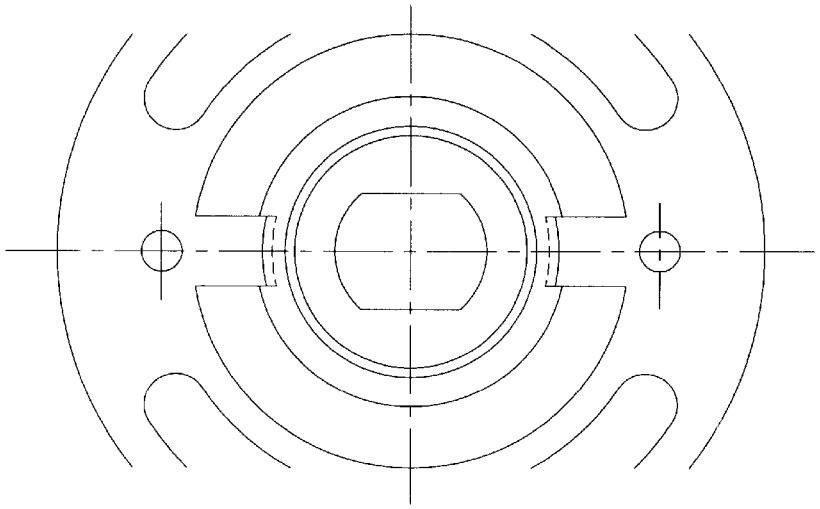
FIG. 7 is an upper view of the previous figure.
Figure 8:
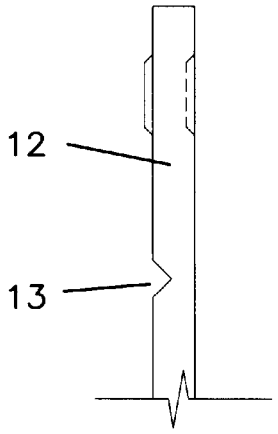
FIG. 8 shows an elevation of a detail at the extremity of the terminals provided for being stapled to the resistive track inside the body in which it is placed.
Figure 9:
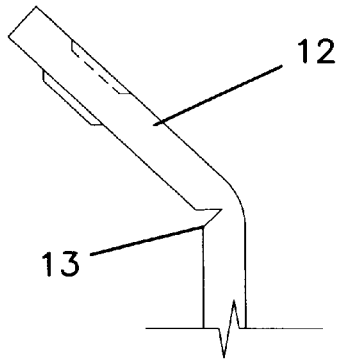
FIG. 9 is similar to the previous figure, showing a position prior to the final stapling.
Figure 10:
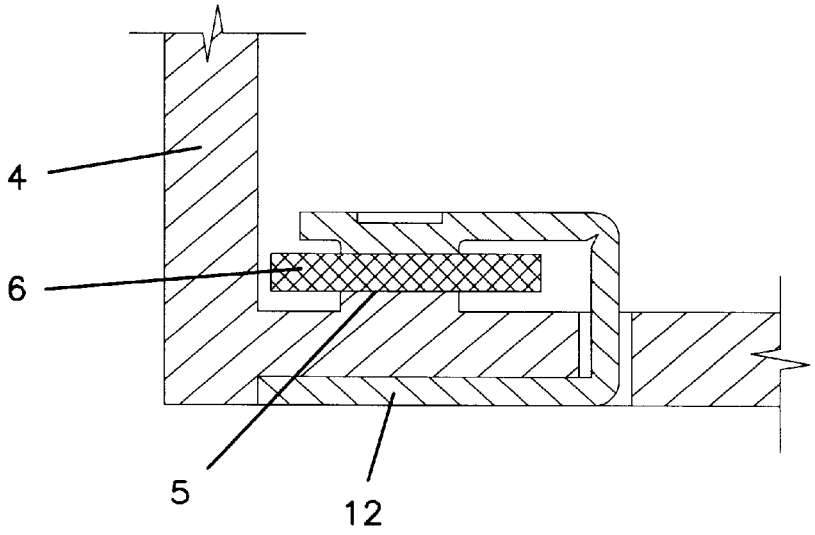
FIG. 10 shows a detail in cross-section of the final stapling of the terminal and the resistive track with the body or housing of the potentiometer.

The improved potentiometer hereby presented incorporates, as it may be observed from the referenced figures of three basic components, the potentiometer element (1), the body of anchorage (2) and the control shaft (3).

The potentiometer element (1) comprises a body or housing (4) of a preferably square-shaped form, and of variable height having at the bottom thereof two or more protuberances (5) of reduced height and situated in such a manner that it coincides with the zone where the ends of the resistive track (6) are to be situated, falling over the latter a double contact of the pointer (7) which in turn, at the upper 3 one thereof, contacts the collector (8) achored in the body or housing (4).

The aforementioned pointer (7) is firmly attached to the rotor (9) which activated by means of the control shaft (3).

The pointer-carrier rotor (9) is attached at an upper part thereof to the collector (8) due to the three or more riveting point by means of plastic deformation (10), while at the lower part thereof it is guided by a cylindrical portion (11) corresponding to the body or housing (4). The terminals (12) have the particularity of having an inside cavity (13) in order to define the bending zone of the same.

The collector (8) of laminer constitution and attached to the body or housing (4) has a drilled part (14) such that its upper part is defined by a radius (15) which emerges over the base and continues descending towards the latter through an angular line. The lower angle is terminated at a bevelled portion (16).

The pointer of laminer cross-section (7) has at a central hole thereof two lugs (17) facing each other, whose essential particularity consists in that the angles formed at their ends have an incisive shape in order to enable them to be inserted in the housing (18) pertaining to the rotor (9).

The potentiometer element (1) is fixed within the achoring body (2) by means of various lugs or rims (19) provided at an extension of walls (20) corresponding to the aforementioned anchoring body (2). Said lugs (19), having arranged the assembly, are bent by plastic deformation in order to obtain an angular form, thus assuring the unity of the assembly. The cavities (21) and notches (22) also contribute in maintaining the unity formed as explained above between the potentiometer element (1) and the anchoring body (2) which inside its anchoring cylindrical portion (23) has a diameter (24) greater than that of the control shaft (3), thus forming in this manner a hollow or cavity (25) capable of retaining certain portion of lubricating grease.

The control shaft (3) provided for facilitating rotation of the pointer carrier rotor (9) has at an insertion end thereof a channel (26) which logically forms the elastic lugs (27) ended at a diameter (28) slightly higher than the stem (29), said diameter (28) ending at a bevelled portion (30) which cooperating with the elasticity of the lugs (27) facilitate the assembly of the control shaft pertaining thereto.

In one of the walls (20) of the anchoring body (2) an opening or window (31) is provided in order to visualize printings corresponding to the coder or characteristics of the element.

Having sufficiently described the nature of the present invention as well as a form of putting it into practice, it only remains to be added that it is possible to introduce change of form, material and disposition in the whole invention or in parts which it comprises, as long as said alterations do not vary substantially the nature of the invention which is claimed as follows:

1. A potentiometer for use in electronic circuits in order to adjust medium and small resistive variations, comprising:

a potentiometer element located inside an anchoring body having a control shaft, wherein the potentiometer element has a resistive track (6) firmly attached to the bottom of a housing (4) by means of a bent extremity of the terminals (12) and by protuberances (5) which act such as elastic spring in the direction of the resistive track, wherein the control shaft (3) has, at an end thereof for insertion in the pointer carrier rotor (9), a channel (26) and a slight widening of the diameter of a stem (29) of the same, said widened diameter being terminated at a bevelled portion (30), the control shaft being removable from the pointer carrier rotor (9).

2. A potentiometer according to claim 1, wherein the ends of the terminals (12) have a transversal cavity (13) provided for bending said terminals.

3. A potentiometer according to claim 1, wherein a collector (8) has a drilled portion (14) which at an upper angle thereof has a round shape (15) which emerges over an upper base of said collector (8) and continues by descending towards said base in an inclined manner, while its lower angle or ridge has a bevelled shape.

4. A potentiometer according to claim 1, wherein at least three points have been arranged by punching through plastic deformation (10) in order for the anchoring and guiding of the upper end of the pointer carrier rotor (9).

5. A potentiometer according to claim 1, wherein lugs (17) of the pointer, at the anchoring point with the rotor (9), are inserted to a housing provided at the upper end of said rotor.

6. A potentiometer according to claim 1, wherein the anchoring body (2) has multiple lugs (19) extending at its walls (20) such that when the lugs (19) are inserted in the potentiometer element (1), the lugs (19) are pressed inwards, remaining fixed by plastic deformation.

7. A potentiometer according to claim 1, wherein at the upper zone of the walls (20) corresponding to the anchoring body (2), multiple notches (22) are positioned which are received in concave cavities situated in the body of the housing (4).

8. A potentiometer according to claim 1, wherein an inside cavity (25)is arranged in a cylindrical portion (23) of the anchoring body for placing lubricant therein.

9. A potentiometer according to claim 1, wherein an opening, capable of permitting the visualization of a printed matter corresponding characteristics of the potentiometer, is formed in one of the walls (20) of the body (2).

* * * * *